US006854130B2

(12) United States Patent
van der Sleesen

(10) Patent No.: US 6,854,130 B2
(45) Date of Patent: Feb. 15, 2005

(54) PROTECTIVE GARMENT

(76) Inventor: Michael van der Sleesen, 23 S. Kingman St., Lakeville, MA (US) 02347-1821

( * ) Notice: Subject to any disclaimer, the term of this patent is extended or adjusted under 35 U.S.C. 154(b) by 221 days.

(21) Appl. No.: 10/210,447

(22) Filed: Aug. 1, 2002

(65) Prior Publication Data

US 2003/0024028 A1 Feb. 6, 2003

Related U.S. Application Data

(60) Provisional application No. 60/309,891, filed on Aug. 3, 2001, and provisional application No. 60/348,021, filed on Nov. 8, 2001.

(51) Int. Cl.[7] ..... A41B 9/14
(52) U.S. Cl. ..... 2/69
(58) Field of Search ..... 2/2.5, 69, 69.5, 2/85, 93, 94, 108, 87, 79, 102, 115, 2.17

(56) References Cited

U.S. PATENT DOCUMENTS 3,731,319 A * 5/1973 O'Neill ..... 2/2.17
3,771,169 A * 11/1973 Edmund ..... 2/2.17
4,535,478 A * 8/1985 Zufle ..... 2/2.5
4,613,991 A * 9/1986 Grover ..... 2/23
5,105,477 A 4/1992 Golde
5,752,277 A * 5/1998 van der Sleesen ..... 2/69
5,918,310 A * 7/1999 Farahany ..... 2/23
6,070,274 A * 6/2000 van der Sleesen ..... 2/456
6,085,353 A 7/2000 van der Sleesen
6,260,196 B1 7/2001 van der Sleesen

FOREIGN PATENT DOCUMENTS

DE 3818566 7/1989

* cited by examiner

*Primary Examiner*—Gary L. Welch
(74) *Attorney, Agent, or Firm*—McDermott Will & Emery LLP

(57) ABSTRACT

A protective garment is presented. The protective garment includes at least one extremity covering piece capable of being attached to a torso covering piece. The extremity covering piece is closable about a length thereof and includes at least one closure element attached to the extremity covering piece. The closure element is capable of closing at least a portion of said extremity covering piece about its length. The protective garment further includes a protective shield member attached to an inner surface of the extremity covering piece.

35 Claims, 4 Drawing Sheets

PROTECTIVE GARMENT

CROSS REFERENCE TO RELATED APPLICATIONS

This application claims priority under 35 U.S.C. § 119(e) to provisional patent application Ser. No. 60/309,891 filed Aug. 3, 2001 and to provisional patent application Ser. No. 60/348,021 filed Nov. 8, 2001; the disclosures of which are incorporated by reference herein.

BACKGROUND OF THE INVENTION

Prior to the present invention it has not been possible to attach a protective pad including a hard shell piece into a sleeve or leg of a protective garment, since the sleeve is typically realized as a tubular structure which prevents stitching of the protective armor in place. Typically the sleeve or entire garment is turned inside out, the protective armor installed, and the garment or sleeve turned right side in. The use of armor having a hard shell makes it impossible to install on an inside out piece then to turn the piece right side in. In view of the foregoing it would be desirable to provide a garment which is able to have armor having a hard shell to be installed, repaired and maintained. It would be further desirable to provide additional ventilation, comfort and protection to the wearer of the garment.

SUMMARY OF THE INVENTION

With the foregoing background in mind, it is an object of the present invention to provide a protective garment. The protective garment includes at least one extremity covering piece capable of being attached to a torso covering piece. The extremity covering piece is closable about a length thereof and includes at least one closure element attached to said extremity covering piece. The closure element is capable of closing at least a portion of said extremity covering piece about its length. The protective garment further includes a protective shield member attached to an inner surface of the extremity covering piece.

BRIEF DESCRIPTION OF THE DRAWINGS

The invention will be better understood by reference to the following more detailed description and accompanying drawings in which.

DETAILED DESCRIPTION

The present invention relates to several improvements in a protective garment such as a motorcycle jacket, a full body suit, leggings chaps, or the like. The present invention provides for ease of manufacturing, repair, improved safety, improved ventilation and improved impact distribution within a protective garment.

The following description references a motorcycle jacket and various parts (sleeves, back) but it should be understood that the present inventions has application to other protective garments and related parts of these other protective garments, for example pants and full body suits.

Additionally, the following description references zippers, hook and loop fasteners and the like though other fasteners such as lacings, buttons, snaps etc. could also be used.

Figure 1A:
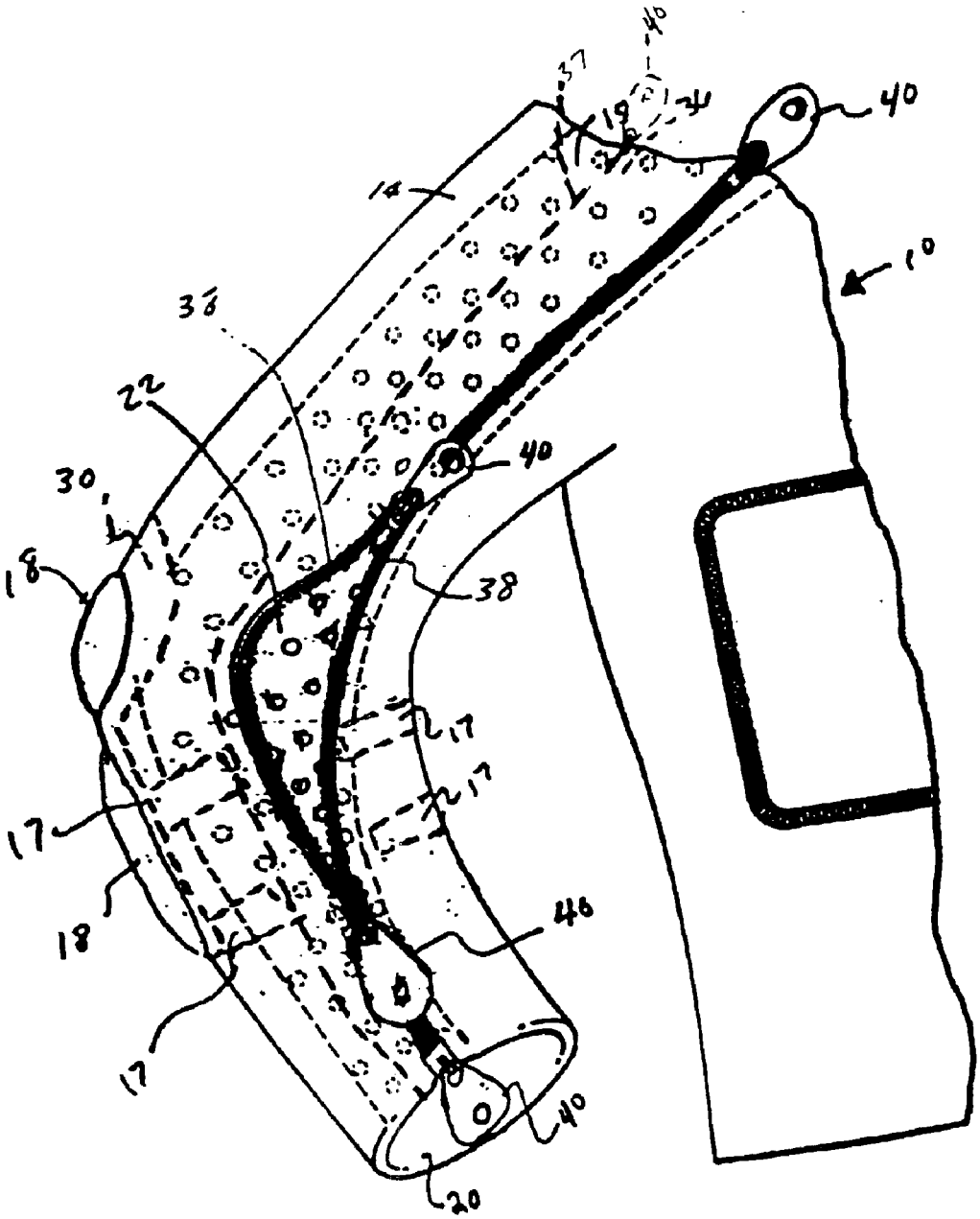
FIG. 1A is a diagram of the sleeve and cover of the present invention.
Figure 1B:
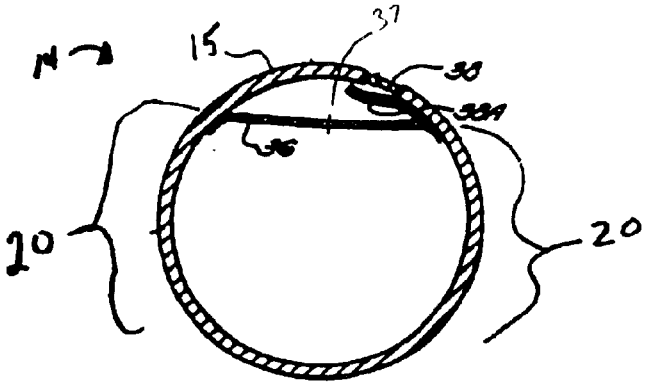
FIG. 1B is a cross-sectional view of the sleeve and cover of the present invention with the cover in a closed position.
Figure 1C:
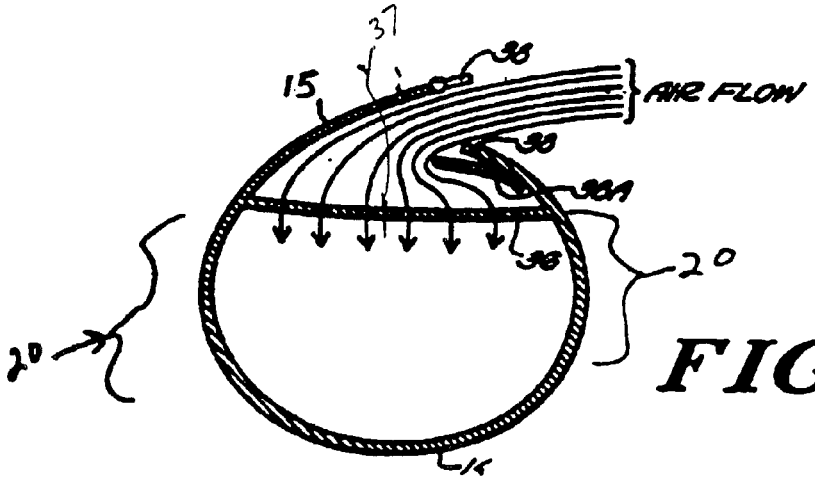
FIG. 1C is a cross-sectional view of the sleeve and cover of the present invention with the cover in an open position.

Referring now to FIGS. 1A–1C, a first aspect of the present invention is shown. A protective garment 10, in this instance a motorcycle jacket, includes a sleeve 14 which includes a cover having a closure extending at least the length of the sleeve. The closure could also extend into the body of the jacket, for example extending along a seam of the jacket piece which fits along or around a torso of a wearer, or in a bodysuit could extend to the ankle. Here, the closure is shown as a zippered closure, though other closure elements such as hook and loop fasteners and the like could also be used. The zippered closure includes a cooperating zipper tooth members and a plurality of zipper headpieces 40. The sleeve comprises a first piece 20 made of an impermeable material such as leather, vinyl, nylon, and the like. The first piece of material can be attached to the second piece of material by being stitched together to form a permanent attachment or can be attached by way of a zipper or hook and loop type fastening which allows for access inside the sleeve when needed. Alternately, the first piece 20 can be made of a permeable material. The sleeve has a second piece 36 which is made of a substantially non-stretchable, dimensionally stable, air permeable material. Second piece 36 also includes a closure 37 extending at least part of the length of second piece 36. The closure 37 is shown as a zippered closure, though other closure elements such as hook and loop fasteners and the like could also be used. The zippered closure 37 includes cooperating zipper tooth members and at least one zipper headpiece 40.

The second piece may be made of air impermeable material such as leather which has been perforated to allow for airflow through the piece. The second piece may incorporate an elastic section to help reduce bulk when the arm is bent, to retain the shape, and maintain the hard outer shell to the wearer's arm. This also aids in reducing billowing of the garment and reduces wearer fatigue. Additionally, this aids in maintaining the armor in the proper position for improved protection.

The sleeve also includes a cover 15 also made of an air impermeable material such as leather. The cover includes an adjustably closable opening 22 extending the length of the cover. The opening is bordered on each side by cooperating zipper parts 38 which are openable and closable by operation of a zipper head 40. The zipper structure may include multiple zipper heads, such that individual portions of the cover may be opened or closed. In the preferred embodiment the zipper heads are locatable anywhere along the zipper extending from the wrist to the waistband of the garment. A zipper head 40 is located at the end of the sleeve to allow the wearer to close the sleeve to provide a snug fit about the wrist of the wearer. An air impermeable windshield flap 38A may be included such that no air passes into the sleeve when the closure is in a closed position. A lower portion of sleeve 14 has a cover under which one or more zipper heads 40 maybe left protected from contact with exterior surfaces (e.g. a motorcycle gas tank). The lower sleeve cover is also useful for adjusting the circumference of the wrist opening.

The sleeve 14 of the protective garment can be fitted with a piece of protective armor 30. The armor 30 can be positioned to protect an elbow of a wearer, a shoulder of a wearer or can extend from shoulder to wrist to provide increased protection of the wearer. Typically the armor 30 will be sewn into the sleeve which covers the edges of the armor with leather, thereby preventing the edges from catching in the event of a crash. Further, the stitching holding the armor in place may be covered, thus protecting the stitching from abrasion in the event of a crash. The prior art would have to attach the hard armor from the exterior, resulting in a raw edge of leather being exposed providing an unfinished look, being subject to abrasion and being uncomfortable for the wearer. The protective armor 30 can include a hard shell 18 for providing impact protection to a person wearing the garment. The hard shell pieces of the body armor are stitched to a soft foam pad that extends beyond the edge of the hard shell pieces in order to protect the wearer from contact with the potentially sharp edges of the hard shell. The outer edge of the hard shell is covered by the leather panel of the garment. This construction results in the hard shell pieces being sandwiched between a soft foam pad and the outer leather panel of the garment, and direct contact with the wearer and the edges of the hard shell are avoided. The hard shell pieces of the body armor may be comprised of poly-ethylene, carbon fiber, resin, metal, fiberglass, styrofoam composites and other materials. Hard armor is generally not permitted in the European Community due to the possibility of injury to the wearer from the sharp edges of the hard shell material, however the above-described encapsulation of the hard shell edges eliminates this concern.

Prior to the present invention it has not been possible to attach a protective pad including a hard shell piece into a sleeve of a protective garment, since the sleeve is typically realized as a tubular structure which prevents stitching of the protective armor in place. Typically the sleeve or entire garment is turned inside out, the protective armor installed, and the garment or sleeve turned right side in. The use of armor having a hard shell makes it impossible to install on an inside out piece then to turn the piece right side in. The present invention overcomes this problem by way of the closable opening 22 extending the length of the sleeve 14. By way of the present invention, the entire length of the sleeve can be opened, the protective armor 30 installed, and the sleeve can then be closed. This also provides for ease of repair or maintenance of the sleeve and the protective armor. In a preferred embodiment the sleeve includes an opening which allows the hard shell 18 of the protective armor to extend through the sleeve 14. In this manner, in the event of an impact, the hard shell additionally serves to protect the sleeve material from abrasions. Additionally, protective armor can be incorporated which protects the shoulder area of a wearer of the garment, or when the garment is a pair of pants or a full body suit, protects the knee of the wearer of the garment.

The closable opening 22 further serves to allow a wearer to adjust the fit of the protective armor about the arm. The allowance of custom fitting of the armor to the wearer provides benefits such as improved safety as hard shell pieces are maintained in the proper close proximity to the wearer to minimize the chance of the armor being shifted out of position in the event of a crash. The adjustability of the armor also provides for increased comfort as it eliminates or reduces distraction or fatigue of the wearer. The adjustability of the armor further allows for ease of disrobing, as a properly fitting hard armor sleeve would be otherwise difficult to remove. The adjustability can also be utilized to compensate for variable undergarment thickness for colder weather riding, warmer weather riding and ventilated liner or spacer fabric. The sleeve 14 may include adjustable straps 17 which extend across the air permeable portion 36 of the sleeve, but still under the cover 15, or in another embodiment the sleeve 14 may include a pre-cut stretchable panel incorporated into portion 36 of the sleeve to perform a similar function as straps 17. Further, a combination of stretchable panels and straps could also be used. The use of straps or stretchable panels allows the user to custom fit the protective armor 30 to the arm. By way of placing the straps over the sleeve but under the cover, the cover area is maintained as a clear surface for the installation of graphics which may be sewn, embroidered or printed on the cover. Additionally, the straps are protected in the event of a crash, and thus are not as likely to be damaged or disturbed which could also cause the protective armor to be displaced from its proper position. Further, by placing the straps under the sleeve cover, the straps are prevented from entanglement with another rider, or with an obstruction. The straps 17 have hook and loop fasteners to provide the adjustable fit, though other fastenings could also be used. While in a preferred embodiment the adjustable straps 17 are located inside the sleeve cover 15, the straps 17 could also be provided external to the cover. The straps may further be elasticized to allow for pump-up of the wearer's arm during physical exertion.

The closable opening 22 additionally provides for venting of the garment. By way of the multiple zipper heads 40, selected portions of the opening 22 can be opened or closed to provide a desired amount of cooling to the wearer, and at the desired location. Additionally, when the torso-covering piece of the jacket also includes the same type of closable opening, the zipper heads can be used to provide the desired cooling to the wearer's torso. The torso-covering piece of the jacket is similar in construction to the above-described sleeve. The torso piece includes a non-permeable piece and an air permeable piece with a cover disposed over the air permeable piece. The cover has an opening extending along a length of the cover. The substantially non-stretchable, dimensionally stable, air permeable piece of material is disposed beneath the opening, such that airflow through the air-permeable piece is provided. The non-stretchable air permeable piece of material may be made of air impermeable material such as leather which has been perforated to allow for airflow through the piece. This piece may incorporate an elastic section proximate the underarm of the wearer to help reduce bulk, to retain the shape, and to maintain the hard outer shell to the wearer. This also aids in reducing billowing of the garment and reduces wearer fatigue. Additionally, this aids in maintaining the armor in the proper position for improved protection.

With respect to both the sleeve piece and the torso covering piece described above, the covering material tends to pouch out or open thus forming a wind scoop. The edge of the wind scoop thus formed may have a stiffener or other retaining material to help define the edge and hold the scoop open. In both cases, the air permeable material is the actual garment while the cover over the air permeable material gives the appearance of being the actual garment from the outside. The arm vent and torso vent provided by the present invention do not cause the body of the garment to fill and billow with wind, but still provide the wearer with large volumes of cooling airflow while being completely adjustable, reducing fatigue, increasing wearer comfort and keeping the armor in the correct position.

A further embodiment includes having one lengthwise side of the second piece of the sleeve 36 connected to the remainder of the sleeve 14 by way of a closure such as a zipper. This zipper extends the full length of the garment between the second piece of the sleeve 36 and the remainder of the sleeve 14.

With such a configuration, there is no gap between the second piece of the sleeve 36 and the torso of the jacket, and the wearer's arm is directed directly into the sleeve when putting on the garment. The second piece of the sleeve 36 can then be closed about the wearer's arm by utilization of the zipper 37. Following the closing of the second part of the sleeve 36 about the wearer's arm, the adjustable straps for the protective armor are positioned to comfortably and securely fit the protective armor about the arm of the wearer. Last, the sleeve cover 15 is selectively closed by positioning of zipper heads 40 along closable opening 22. Preferably the zipper for the second sleeve piece 36 and the sleeve cover zipper 38 are positioned non-coaxial aligned to prevent overlap of the zipper seams. Further wind sealing may be provided by a weather proof strip/flap 38A. Also a snug wrist fit, desirable to have a wind-tight fit under gloves, is achieved by closing first zipper 37 then the sleeve cover zipper 38.

By way of the above-described configuration, the field of ventilation is increased from the wrist to the waist. The size of the garment is not increased when the zippers are opened as the air is channeled through the jacket (no billowing). Another advantage associated with the above described configuration is that the garment can be laid entirely flat and open (by opening outer closure 38 and opening inner closure 37) during assembly or repair or other work done to the garment.

While the closure, extremity covering piece, second piece, cover etc. of the present invention can be incorporated in any location on the extremity covering piece and/or the torso covering piece, they are preferably provided along a seam of the extremity covering and/or a seam of the torso covering piece.

Figure 2:
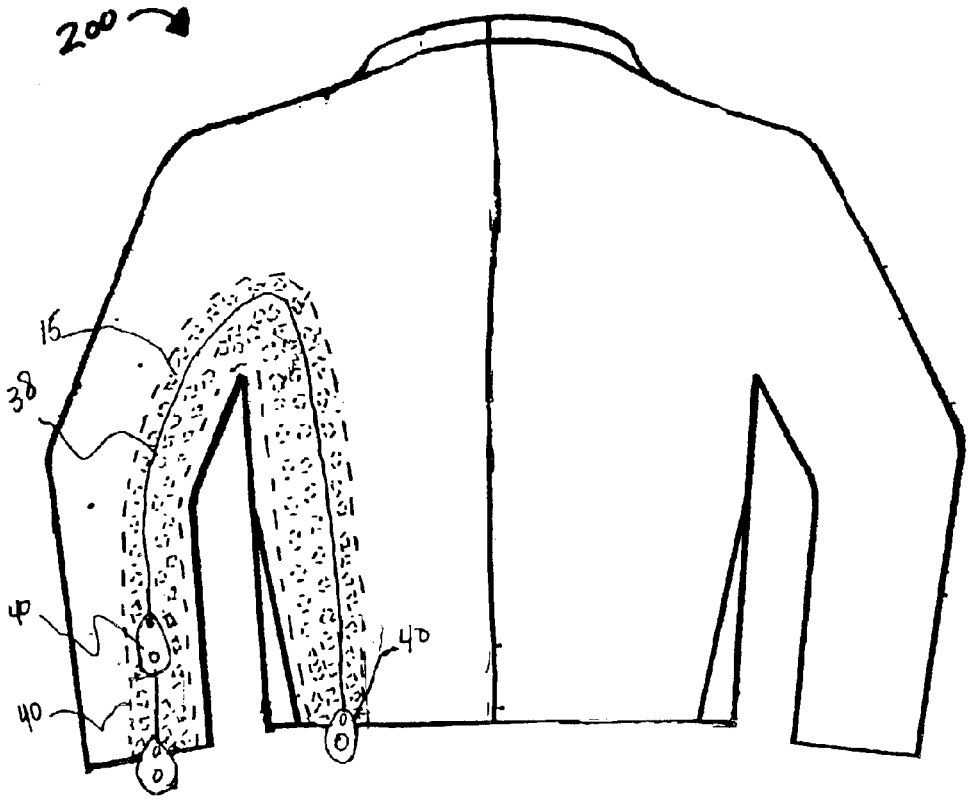
FIG. 2 is a frontal diagram of the jacket configuration.
Figure 3:
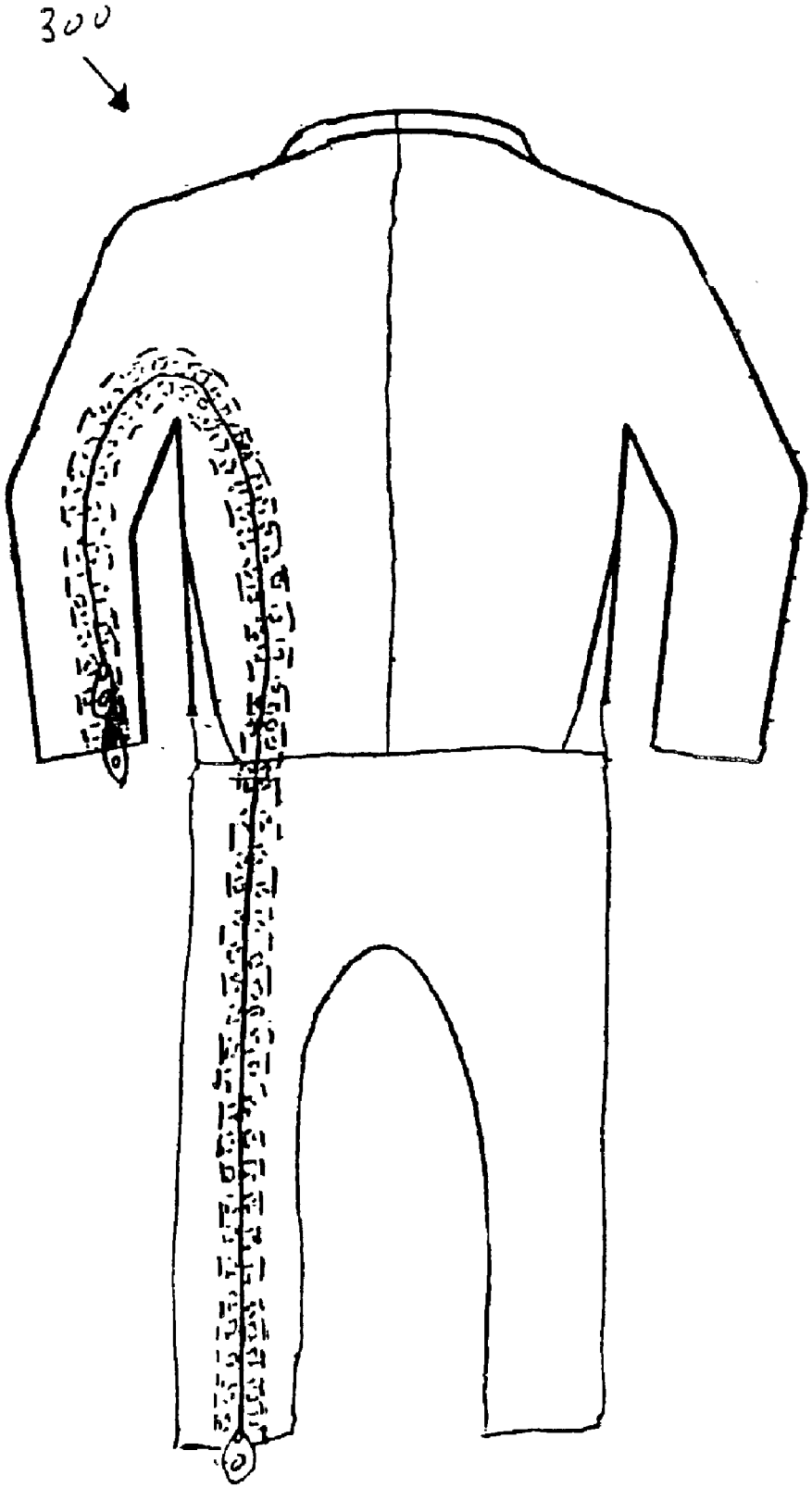
FIG. 3 is a frontal diagram of the bodysuit configuration.

As described above, the closable opening can extend the length of the garment. For a jacket 200, the opening extends from the wrist opening to the waistband, as shown in FIG. 2. For leggings or chaps the opening extends from the waistband to the ankle opening, as shown in FIG. 3. For a bodysuit 300, the opening extends from the wrist opening, along the torso, and to the ankle opening, also shown in FIG. 3. Alternatively, a full body suit may contain arm/torso openings and perhaps an inseam opening from ankle to crotch to ankle. In the examples shown in FIGS. 2 and 3, the remainder of the opening is the same as described in relation to FIGS. 1A–1C, and include a cover, an air permeable piece, a zipper having multiple zipper heads, etc.

A protective garment has been presented. The protective garment includes at least one extremity covering piece capable of being attached to a torso covering piece. The extremity covering piece is closable about a length thereof and includes at least one closure element attached to said extremity covering piece. The closure element is capable of closing at least a portion of said extremity covering piece about its length. The protective garment further includes a protective shield member attached to an inner surface of the extremity covering piece.

Having described preferred embodiments of the invention it will now become apparent to those of ordinary skill in the art that other embodiments incorporating these concepts may be used. Accordingly, it is submitted that that the invention should not be limited to the described embodiments but rather should be limited only by the spirit and scope of the appended claims.

What is claimed is:

1. A protective garment comprising:

at least one extremity covering piece capable of being attached to a torso covering piece, wherein said at least one extremity covering piece extends along a longitudinal central axis and includes:

an elongated air impermeable section extending along said longitudinal axis and having at least one vent region; and an air permeable section spanning said vent region;

wherein said air permeable section includes a closure assembly extending along said longitudinal axis for selectively opening and closing said vent region, and wherein said extremity covering piece includes a protective shield member locus on an inner surface of said air impermeable section opposite said air permeable section.

2. The protective garment of claim 1 wherein said air impermeable section and said air permeable section form a unitary structure.

3. The protective garment of claim 2 wherein said air impermeable section is removably attachable to said air permeable section.

4. The protective garment of claim 2 wherein said air impermeable section is fixedly attached to said air permeable section.

5. The protective garment of claim 1 wherein said torso covering piece comprises an air permeable section and an air impermeable section.

6. The protective garment of claim 5 wherein said closure assembly is further attached to said torso covering piece and is capable of closing at least a portion of said torso covering piece.

7. The protective garment of claim 1 wherein said extremity covering piece further comprises a cover section affixed to said air impermeable section and spanning said vent region, and wherein said cover section includes a second closure assembly extending along said longitudinal axis opposite said vent region.

8. The protective garment of claim 7 wherein when said closure assembly of said cover section is partially or fully disengaged, an opening is provided along at least a portion of the length of said cover section of said extremity covering piece, said opening permitting the passage of air through said cover section to said air permeable section of said extremity covering piece.

9. The protective garment of claim 7 wherein said torso covering piece includes a closure assembly in connection with said closure assembly of said cover section, forming a unitary closure assembly, wherein when said unitary closure assembly is partially or fully disengaged, an opening is provided along a portion of unitary closure assembly, said opening permitting the passage of air through said unitary closure assembly.

10. The protective garment of claim 7 wherein said closure assembly of said cover section extends along an entire length of said cover section.

11. The protective garment of claim 7 wherein said cover section is air impermeable.

12. The protective garment of claim 7 wherein said closure assembly of said cover section is selected from the group consisting of a zipper, a hook and loop fastener, a snap, and a button and button hole combination.

13. The protective garment of claim 12 wherein said zipper comprises a multi-headed zipper.

14. The protective garment of claim 7 wherein said elongated air impermeable section and said cover section form a unitary structure.

15. The protective garment of claim 1 wherein said closure assembly is selected from the group consisting of a zipper, a hook and loop fastener, a snap, and a button and button hole combination.

16. The protective garment of claim 15 wherein said zipper comprises a multi-headed zipper.

17. The protective garment of claim 1 wherein said protective shield member locus comprises a hole defined through said air impermeable section of said extremity covering piece.

18. The protective garment of claim 1 wherein said extremity covering piece further includes adjustable straps to fit about an extremity of a user of said protective garment.

19. The protective garment of claim 18 wherein said adjustable straps are elasticized.

20. The protective garment of claim 18 wherein said adjustable straps are located between said cover section and said air permeable section.

21. The protective garment of claim 18 wherein said adjustable straps are located over said cover section.

22. The protective garment of claim 1 wherein said garment is selected from the group consisting of jackets, leggings, chaps, and full body suits.

23. The protective garment of claim 1 wherein said extremity covering piece comprises material selected from the group consisting of leather, vinyl, nylon, and canvas.

24. The protective garment of claim 1 wherein said torso covering piece is selected from the group consisting of leather, vinyl, nylon, and canvas.

25. The protective garment of claim 1 wherein said extremity covering piece comprises a sleeve of a garment selected from the group consisting of a jacket and a full body suit.

26. The protective garment of claim 1 wherein said extremity covering piece comprises a leg of a garment selected from the group consisting of leggings, chaps, and a full body suit.

27. The protective garment of claim 1 wherein said garment comprises a jacket, and said closure assembly extends from a distal end of said extremity covering piece to a distal end of said torso covering piece.

28. The protective garment of claim 1 wherein said garment is selected from the group including leggings and chaps, and said closure assembly extends from a distal end of said extremity covering piece to a distal end of said torso covering piece.

29. The protective garment of claim 1 wherein said garment comprises a bodysuit, and said closure assembly extends from a distal end of said extremity covering piece, through said torso covering piece and to a distal end of a second extremity covering piece.

30. The protective garment of claim 1 wherein said closure assembly extends along an entire length of said air permeable section.

31. The protective garment of claim 1 wherein said extremity covering piece further includes a protective shield member disposed on said protective shield member locus.

32. The protective garment of claim 1 wherein said extremity covering piece further includes a protective shield member affixed to said inner surface of said air impermeable section of said extremity covering piece.

33. The protective garment of claim 32 wherein said protective shield member is affixed to said inner surface of said air impermeable section of said extremity covering piece by stitches.

34. The protective garment of claim 1 wherein said vent region extends to a portion of said extremity covering piece that is farthest from said attachment of said extremity covering piece to said torso.

35. The protective garment of claim 34 wherein said closure element extends to a portion of said air permeable section that is farthest from said attachment of said extremity covering piece to said torso.

* * * * *